US007836866B2

(12) United States Patent
Luken et al.

(10) Patent No.: US 7,836,866 B2
(45) Date of Patent: Nov. 23, 2010

(54) METHOD FOR CONTROLLING CYLINDER DEACTIVATION

(75) Inventors: Todd R. Luken, Dublin, OH (US); David S. Bates, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 194 days.

(21) Appl. No.: 12/123,912

(22) Filed: May 20, 2008

(65) Prior Publication Data

US 2009/0292439 A1 Nov. 26, 2009

(51) Int. Cl.
*F02D 7/00* (2006.01)
*F02D 7/02* (2006.01)

(52) U.S. Cl. ..... 123/481; 701/112

(58) Field of Classification Search ..... 123/481, 123/325, 332, 198 F; 701/112
See application file for complete search history.

(56) References Cited

U.S. PATENT DOCUMENTS 4,064,844 A * 12/1977 Matsumoto et al. ..... 123/481
4,153,033 A * 5/1979 Iizuka ..... 123/198 F
4,172,434 A 10/1979 Coles
4,409,936 A 10/1983 Dozono
5,492,100 A * 2/1996 Ishii et al. ..... 123/481
6,138,636 A * 10/2000 Kohno et al. ..... 123/198 F
6,694,232 B2 * 2/2004 Saito et al. ..... 701/22
6,874,463 B1 4/2005 Bolander et al.
6,904,752 B2 6/2005 Foster et al.
6,943,460 B2 9/2005 Wakashiro et al.
7,104,244 B2 9/2006 Nishi et al.
7,188,468 B2 * 3/2007 Fukusako et al. ..... 60/285
2005/0279320 A1 12/2005 Roberts et al.
2006/0107919 A1 * 5/2006 Nishi et al. ..... 123/198 F
2006/0130814 A1 6/2006 Bolander et al.
2007/0068486 A1 3/2007 Rozario et al.

OTHER PUBLICATIONS

Search Report, dated Aug. 10, 2009, from European Patent Application No. EP 09 16 062.4.

* cited by examiner

*Primary Examiner*—Mahmoud Gimie
(74) *Attorney, Agent, or Firm*—Plumsea Law Group, LLC; Mark E. Duell

(57) ABSTRACT

A method of controlling a cylinder deactivation system is disclosed. Information from one or more sensors is received by a control unit. The control unit compares the current values of a parameter with one or more prohibited ranges in order to determine if cylinder deactivation should be prohibited. The one or more prohibited ranges are discrete ranges, each with a lower limit and an upper limit.

30 Claims, 8 Drawing Sheets

METHOD FOR CONTROLLING CYLINDER DEACTIVATION

BACKGROUND OF THE INVENTION

1. Field of the Invention

The present invention relates to motor vehicles and in particular to a method for controlling cylinder deactivation.

2. Description of Related Art

Methods for controlling cylinder deactivation have been previously proposed. Bolander (U.S. patent number 2006/0130814) is directed to a method of regulating a displacement on demand (DOD) engine. The Bolander method teaches adjusting activation of a first cylinder to partially achieve the desired engine displacement and subsequently adjusting activation of a second cylinder to fully achieve the desired engine displacement. In other words, instead of activating multiple cylinders simultaneously, a first cylinder is activated, followed by a second cylinder being activated. During a first step before partial deactivation, the control device determines whether the displacement on demand system should be disabled. The displacement on demand system is disabled whenever the vehicle is in a situation where activation of the DOD system would be inappropriate. Such conditions include that the vehicle is in a transmission mode other than drive (i.e. park, reverse or low range). Other situations include the presence of engine controller faults, cold engine, improper voltage levels and improper fuel and/or oil pressure levels.

Foster (U.S. Pat. No. 6,904,752) is directed to an engine cylinder deactivation system that improves the performance of the exhaust emission control systems. The Foster design discloses a cylinder deactivation system to control temperature and air/fuel ratio of an exhaust gas feed-stream going into an after-treatment device. Foster teaches cylinder deactivation for controlling temperature of the exhaust gas continues as long as the operating point of the engine remains below a predetermined level, or the coolant temperature is below the operating range of 82-91 degrees C., or the exhaust gas temperature is below an optimal operating temperature of the after-treatment device, e.g. 250 degrees C. In other words, the Foster device uses a single threshold limit for the engine operating level, the coolant temperature and the exhaust gas temperature.

Donozo (U.S. Pat. No. 4,409,936) is directed to a split type internal combustion engine. In the Donozo design, the internal combustion engine comprises a first and second cylinder unit, each including at least one cylinder, a sensor means for providing a signal indicative of engine vibration and a control means for disabling the first cylinder unit when the engine load is below a predetermined value. The controller means is adapted to hold the first cylinder unit active, regardless of engine load conditions, when the engine vibration indicator signal exceeds a predetermined value indicating unstable engine operation. In the Dozono design, cylinder deactivation may occur during low load conditions any time the measured vibrations are below a particular threshold value. Dozono does not teach a method where cylinder deactivation is stopped for low load conditions based on engine speed.

Wakashiro (U.S. Pat. No. 6,943,460) is directed to a control device for a hybrid vehicle. The Wakashiro design teaches a method for determining if cylinder deactivation should be used and a separate method for determining if the engine is in a permitted cylinder deactivation operation zone. The factors used to determine if the engine is in a permitted cylinder deactivation zone are the temperature of the engine cooling water, the vehicle speed, the engine revolution rate, and the depression amount of the accelerator pedal. In each case, these factors are evaluated based on a single predetermined threshold. In other words, if each of these factors is determined to be above or below (depending on the factor) a predetermined threshold, the cylinder deactivation operation is prevented.

While the prior art makes use of several parameters in order to determine if cylinder deactivation should be stopped, there are shortcomings. The prior art teaches only threshold limits above which cylinder deactivation can continue and below which cylinder deactivation should be stopped. Also, the prior art does not teach the use of stop deactivation dependent on various parameters including engine speed, vehicle speed, transmission ratio, or engine load. There is a need in the art for a system and method that addresses these problems.

SUMMARY OF THE INVENTION

A method for controlling cylinder deactivation is disclosed. Generally, these methods can be used in connection with an engine of a motor vehicle. The invention can be used in connection with a motor vehicle. The term "motor vehicle" as used throughout the specification and claims refers to any moving vehicle that is capable of carrying one or more human occupants and is powered by any form of energy. The term motor vehicle includes, but is not limited to cars, trucks, vans, minivans, SUV's, motorcycles, scooters, boats, personal watercraft, and aircraft.

In some cases, the motor vehicle includes one or more engines. The term "engine" as used throughout the specification and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy, for example, some engines include regenerative braking systems where kinetic energy from a drivetrain is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In one aspect, the invention provides a method for controlling cylinder deactivation in a motor vehicle comprising the steps of: determining the availability of a cylinder deactivation mode; receiving information related to a parameter associated with an operating condition of the motor vehicle; comparing the parameter with a predetermined prohibited range, the predetermined prohibited range having a lower limit and an upper limit; and prohibiting cylinder deactivation when the parameter is within the predetermined prohibited range.

In another aspect, the parameter is engine speed.

In another aspect, the parameter is vehicle speed.

In another aspect, the parameter is transmission condition.

In another aspect, the parameter is engine load.

In another aspect, the invention provides a method for controlling cylinder deactivation in a motor vehicle comprising the steps of: receiving information related to a parameter associated with an operating condition of the motor vehicle; comparing the parameter with a predetermined prohibited range, the predetermined prohibited range having a lower limit and an upper limit; permitting cylinder deactivation when a value of the parameter is below the lower limit of the predetermined prohibited range; prohibiting cylinder deactivation when the parameter is within the predetermined prohibited range; permitting cylinder deactivation when the value of the parameter is above the upper limit of the predetermined prohibited range; and where the lower limit has a value that is less than the upper limit.

In another aspect, the parameter is engine speed.

In another aspect, the parameter is vehicle speed.

In another aspect, the parameter is transmission condition.

In another aspect, the parameter is engine load.

In another aspect, there are multiple deactivated cylinder modes.

In another aspect, the invention provides a method for controlling cylinder deactivation in a motor vehicle including an engine having a plurality of cylinders comprising the steps of: establishing a maximum cylinder mode wherein all of the plurality of cylinders is operated; establishing a minimum cylinder mode wherein a minimum number of cylinders is operated, wherein the minimum number is less than the maximum number; establishing an intermediate cylinder mode wherein an intermediate number of cylinders is operated, wherein the intermediate number is less than the maximum number but greater than the minimum number; receiving information related to a parameter associated with an operating condition of the motor vehicle; comparing the parameter with a predetermined prohibited range; prohibiting cylinder deactivation to the minimum number of cylinders when the parameter is within the predetermined prohibited range, but permitting cylinder deactivation to the intermediate number of cylinders.

In another aspect, the maximum number of cylinders is six.

In another aspect, the maximum number of cylinders is eight.

In another aspect, the maximum number of cylinders is ten.

In another aspect, the maximum number of cylinders is twelve.

In another aspect, the maximum number of cylinders is six, the minimum number is three and the intermediate number is four.

In another aspect, the maximum number of cylinders is eight, the minimum number is four and the intermediate number is six.

In another aspect, the maximum number of cylinders is ten, the minimum number is five and the intermediate number is six.

In another aspect, the maximum number of cylinders is twelve, the minimum number is six and the intermediate number is eight.

In another aspect, the invention provides a method for controlling cylinder deactivation in a motor vehicle comprising the steps of: determining the availability of a cylinder deactivation mode; receiving information related to a parameter associated with an operating condition of the motor vehicle; comparing the parameter with a first predetermined prohibited range and a second predetermined prohibited range, the first predetermined prohibited range having a first lower limit and a first upper limit and the second predetermined prohibited range having a second lower limit and a second upper limit; the second lower limit being greater than the first upper limit; and prohibiting cylinder deactivation when the parameter is within either the first predetermined prohibited range or the second predetermined prohibited range.

In another aspect, the parameter is engine speed.

In another aspect, the parameter is vehicle speed.

In another aspect, the parameter is engine load.

In another aspect, the parameter is transmission condition.

In another aspect, the invention provides a method for controlling cylinder deactivation in a motor vehicle comprising the steps of: receiving information related to a parameter associated with an operating condition of the motor vehicle; comparing the parameter with a first predetermined prohibited range, the first predetermined prohibited range having a first lower limit and a first upper limit greater than the first lower limit; comparing the parameter with a second predetermined prohibited range, the second predetermined prohibited range having a second lower limit and a second upper limit, the second lower limit being less than the second upper limit and greater than the first upper limit; permitting cylinder deactivation when a value of the parameter is below the first lower limit of the first predetermined prohibited range; prohibiting cylinder deactivation when the parameter is within the first predetermined prohibited range; permitting cylinder deactivation when the value of the parameter is above the first upper limit of the first predetermined prohibited range and below the second lower limit of the second predetermined prohibited range; prohibiting cylinder deactivation when the parameter is within the second predetermined prohibited range; and permitting cylinder deactivation when the value of the parameter is above the second upper limit of the second predetermined prohibited range.

In another aspect, the parameter is engine speed.

In another aspect, the parameter is vehicle speed.

In another aspect, the parameter is transmission condition.

In another aspect, the parameter is engine load.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
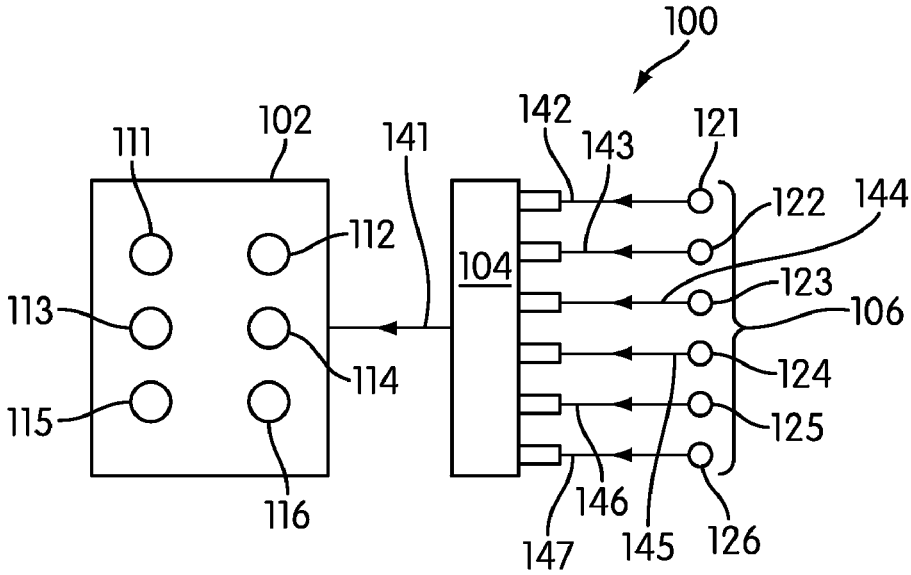
FIG. 1 is a schematic view of a preferred embodiment of a cylinder deactivation system.

FIG. 1 is a schematic view of a preferred embodiment of cylinder deactivation system 100. Preferably, cylinder deactivation system 100 may comprise engine 102, control unit 104 and sensor system 106. In some embodiments, cylinder deactivation system 100 could include additional components, such as multiple engines and/or multiple sensor systems. In a preferred embodiment, cylinder deactivation system 100 may be part of a motor vehicle of some kind.

In the current embodiment, engine 102 includes first cylinder 111, second cylinder 112, third cylinder 113, fourth cylinder 114, fifth cylinder 115 and sixth cylinder 116. For purposes of clarity, engine 102 is shown in FIG. 1 as a six cylinder engine. In other embodiments, engine 102 may include more or less than six cylinders. For example, other preferred embodiments of engine 102 could include three cylinders, four cylinders, eight cylinders, nine cylinders, ten cylinders or twelve cylinders. Generally, engine 102 could include any desired number of cylinders.

In the preferred embodiment, sensor system 106 may comprise multiple sensors. Preferably, sensor system 106 includes one or more of the following sensors: engine speed sensor 121, vehicle speed sensor 122, intake manifold sensor 123, throttle angle sensor 124, airflow sensor 125 and transmission sensor 126. In other embodiments, sensor system 106 may include additional sensors. In a preferred embodiment, sensor system 106 includes each of the sensors 121-126.

In some embodiments, cylinder deactivation system 100 may also include control unit 104. Preferably, control unit 104 may be an electronic device or may include a computer of some type configured to communicate with engine 102 and sensor system 106. Control unit 104 may also be configured to communicate with and/or control other devices or systems within a motor vehicle.

Generally, control unit 104 may communicate with engine 102 and sensor system 106 using any type of connection, including both wired and/or wireless connections. In some embodiments, control unit 104 may communicate with engine 102 via first connection 141. Additionally, control unit 104 may communicate with engine speed sensor 121, vehicle speed sensor 122, intake manifold sensor 123, throttle angle sensor 124, airflow sensor 125 and transmission sensor 126 via second connection 142, third connection 143, fourth connection 144, fifth connection 145, sixth connection 146 and seventh connection 147. With this preferred configuration, control unit 104 may function to control engine 102, especially in response to various operating conditions of the motor vehicle as measured or determined by sensor system 106.

Figure 2:
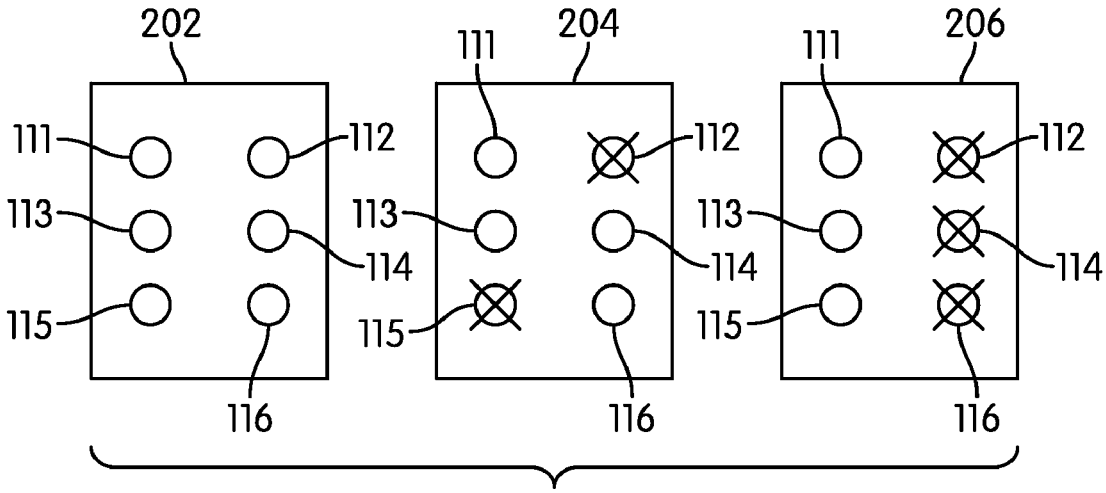
FIG. 2 is a schematic view of a preferred embodiment of several configurations for cylinder deactivation.

Preferably, control unit 104 may include provisions for cylinder deactivation in order to modify the engine displacement and thereby increase fuel efficiency in situations where load demands do not require all cylinders to be operating. Cylinder deactivation occurs whenever one or more cylinders within engine 102 are not used. In some embodiments, there may be more than one mode of cylinder deactivation. Referring to FIG. 2, engine 102 may be operated in maximum cylinder mode 202, intermediate cylinder mode 204 or minimum cylinder mode 206. Preferably, maximum cylinder mode 202 operates using the maximum number of cylinders, minimum cylinder mode 206 operates using some number of cylinders less than the maximum number, and intermediate cylinder mode 204 operates using some number of cylinders between the maximum and minimum number of cylinders. Any cylinder mode using less than the maximum number of cylinders may be referred to as a 'deactivated cylinder mode'.

In the preferred embodiment, during maximum cylinder mode 202, cylinders 111-116 are all preferably operating. During intermediate cylinder mode 204, first cylinder 111, third cylinder 113, fourth cylinder 114 and sixth cylinder 116 remain operating, while second cylinder 112 and fifth cylinder 115 are deactivated. Finally, during minimum cylinder mode 206, first cylinder 111, third cylinder 113 and fifth cylinder 115 remain operating while second cylinder 112, fourth cylinder 114 and sixth cylinder 116 are deactivated. In other words, in the preferred embodiment, maximum cylinder mode 202 is a six cylinder mode, intermediate cylinder mode is a four cylinder mode and minimum cylinder mode is a three cylinder mode. However, in other embodiments, each cylinder mode may use a different number of cylinders during operation.

In different embodiments, each cylinder mode can be achieved by deactivating different cylinders. Generally, any combination of cylinders may be deactivated in order to achieve a deactivated cylinder mode. In embodiments including an intermediate, or four cylinder, mode, any combination of two cylinders can be deactivated to achieve the intermediate mode. For example, in another embodiment, intermediate cylinder mode 204 can be achieved by deactivating first cylinder 111 and sixth cylinder 116 and allowing the other cylinders to remain activated. In still another embodiment, intermediate cylinder mode 204 can be achieved by deactivating fifth cylinder 115 and sixth cylinder 116. In still other embodiments, any other two cylinders can be deactivated. Likewise, in embodiments including a minimum, or low cylinder, mode any combination of three cylinders can be deactivated to achieve the minimum mode. For example, in another embodiment, first cylinder 111, third cylinder 113 and fifth cylinder 115 may be deactivated and second cylinder 112, fourth cylinder 114 and sixth cylinder 116 may remain activated to achieve minimum cylinder mode 206.

Generally, engine 102 may switch between maximum, intermediate and minimum (in this case six, four and three) cylinder modes according to current power demands. For high power demands, engine 102 may be operated in maximum cylinder mode 202. For low power demands, engine 102 may be operated in minimum cylinder mode 206. For intermediate power demands, engine 102 may be operated in intermediate cylinder mode 204. In some cases, control unit 104 or another device may monitor current power demands and facilitate switching engine 102 between the minimum, intermediate and maximum cylinder modes 206, 204 and 202, according to these power demands.

The configurations described here for cylinder deactivation are the preferred configurations. In particular, both intermediate cylinder mode 204 and minimum cylinder mode 206 include configurations of cylinders that are symmetric. These symmetric configurations will decrease the tendency of engine 102 to be unbalanced during operation. When engines with more than six cylinders are used, various other configurations of cylinder deactivation could also be accommodated.

Sometimes, problems may occur during cylinder deactivation. Under certain operating conditions, when an engine is in a deactivated cylinder mode, the engine mounts and exhaust system must operate under increased vibrations and exhaust flow pulsations. Additionally, drivetrain components can also introduce additional vibrations. In some cases, unacceptable levels of noise vibration and harshness (NVH) may occur and negatively impact the comfort of the driver and/or passengers within a motor vehicle.

Preferably, cylinder deactivation system 100 includes provisions for reducing or eliminating occurrences of unacceptable NVH within a motor vehicle due to cylinder deactivation. In some embodiments, cylinder deactivation may be prohibited under certain operating conditions of the motor vehicle, even when the current engine load does not require the use of all six cylinders 111-116. In a preferred embodiment, control unit 104 may be configured to prohibit or stop cylinder deactivation when various operating parameters measured using sensor system 106 lie within discrete prohibited ranges.

Figure 3:
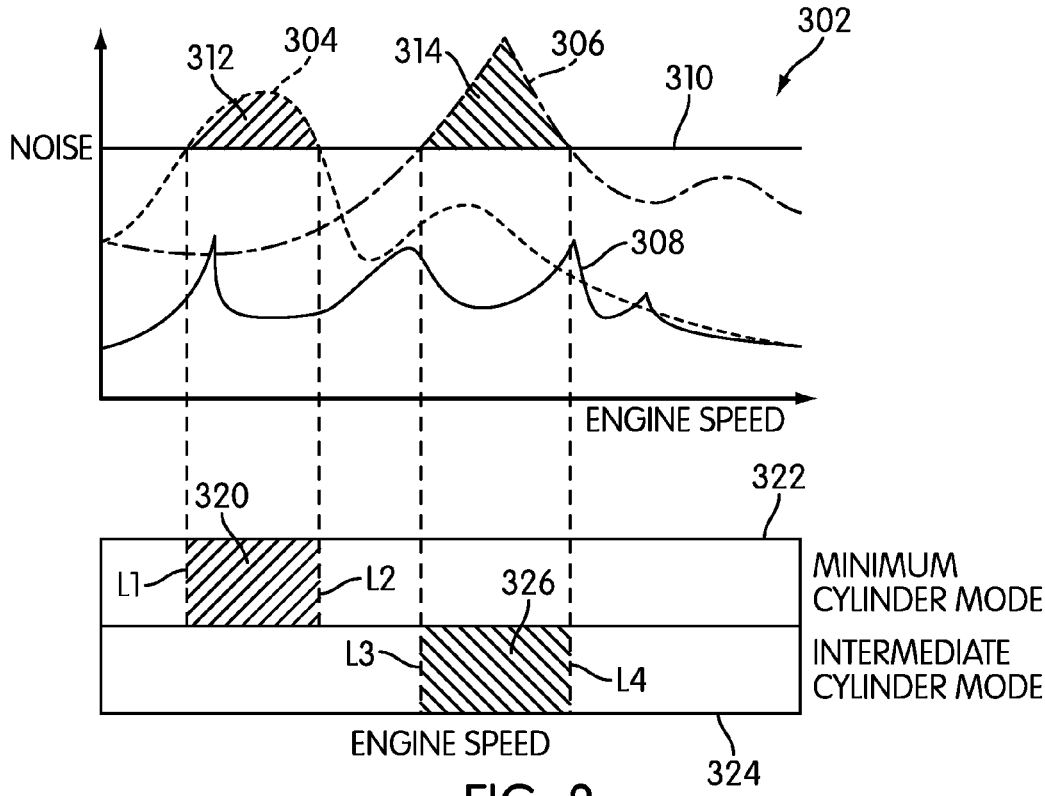
FIG. 3 is a preferred embodiment of a relationship showing prohibited noise regions.

Referring to FIG. 3, discrete ranges of engine speed may be associated with unacceptable levels of noise whenever engine 102 is in a deactivated cylinder mode. Relationship 302 is a preferred embodiment of noise vs. engine speed for various engine displacement modes. The noise, as used here, could be NVH in particular, as experienced by a driver or passenger in the cabin of the motor vehicle. In particular, minimum cylinder line 304, intermediate cylinder line 306 and maximum cylinder line 308 are illustrated and represent the value of noise as a function of engine speed for minimum cylinder mode 206, intermediate cylinder mode 204 and maximum cylinder mode 202 of engine 102 (see FIG. 2), respectively. Noise limit 310 represents the upper limit on acceptable noise.

As seen in FIG. 3, minimum cylinder line 304 includes first peak 312, disposed above noise limit 310. Also, intermediate cylinder line 306 includes second peak 314, disposed above noise limit 310. Finally, it is clear that maximum cylinder line 308 is disposed below noise limit 310 for all speeds. This is to be expected since, presumably, engine 102 (see FIG. 1) is tuned to limit noise for maximum cylinder mode 202 (see FIG. 2) at all engine speeds.

In this preferred embodiment, first peak 312 of minimum cylinder line 304 corresponds to a range of engine speeds within first engine speed range 322. First engine speed range 322 preferably includes the entire range of possible engine speeds for engine 102. In particular, first peak 312 of minimum cylinder line 304 corresponds to first prohibited range 320. First prohibited range 320 may be limited below by first lower limit L1 and bounded above by first upper limit L2. In this embodiment, if the current engine speed has a value that lies within first prohibited range 320, undesired noise may occur when the engine is operating in minimum cylinder mode 206.

Second peak 314 of intermediate cylinder line 306 also preferably corresponds to a range of engine speeds within second engine speed range 324. Second engine speed range 324 is preferably identical to first engine speed range 322, including the entire range of possible engine speeds for engine 102. In this embodiment, second peak 314 of intermediate cylinder line 306 corresponds to second prohibited range 326. Second prohibited range 326 may be limited below by second lower limit L3 and bounded above second upper limit L4. In this embodiment, if the current engine speed has a value that lies within the second prohibited range 326, undesired noise may occur when the engine is operating in intermediate cylinder mode 204.

Prohibited ranges 320 and 326 are only meant to be illustrative of possible ranges of engine speed where undesirable noise may occur. In other embodiments, prohibited ranges 320 and 326 may be any ranges, as determined by various empirical or theoretical considerations. In the preferred embodiment, control unit 104 may be configured to include these predetermined prohibited ranges that may be used in controlling cylinder deactivation. Furthermore, all prohibited ranges discussed throughout this detailed description are only meant to illustrate possible prohibited ranges, including prohibited ranges of various types of parameters associated with varying levels of noise. In other embodiments, each prohibited range may vary.

Figure 4:
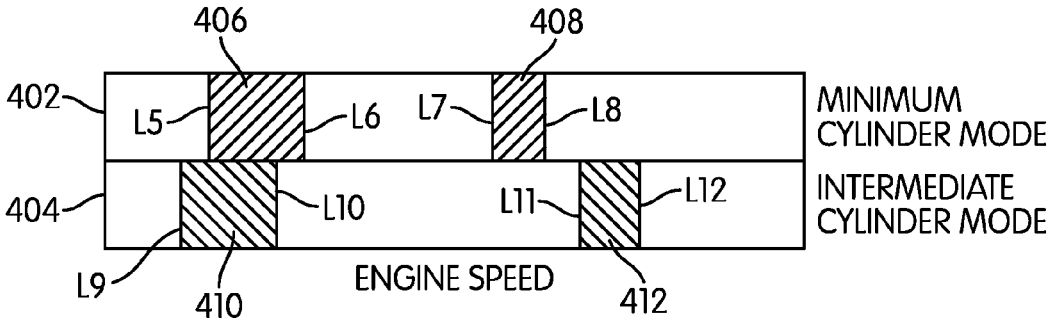
FIG. 4 is a preferred embodiment of a relationship showing multiple prohibited noise regions.

In other embodiments, each cylinder mode 204 and 206 may include multiple prohibited ranges for engine speed. FIG. 4 is a preferred embodiment of prohibited ranges 400 of third engine speed range 402 and fourth engine speed range 404, corresponding to the possible range of engine speeds for minimum cylinder mode 206 and intermediate cylinder mode 204, respectively. In this embodiment, third engine speed range 402 includes third prohibited range 406 and fourth prohibited range 408. Third prohibited range 406 is preferably bounded below by third lower limit L5 and bounded above by third upper limit L6. Fourth prohibited range 408 is preferably bounded below by fourth lower limit L7 and bounded above by fourth upper limit L8. In this embodiment, if the current engine speed has a value that lies within third prohibited range 406 or fourth prohibited range 408, undesired noise may occur when the engine is operating in minimum cylinder mode 206.

In addition, fourth engine speed range 404 preferably includes fifth prohibited range 410 and sixth prohibited range 412. Fifth prohibited range 410 is preferably bounded below by fifth lower limit L9 and bounded above by fifth upper limit L10. Sixth prohibited range 412 is preferably bounded below by sixth lower limit L11 and bounded above by sixth upper limit L12. In this embodiment, if the current engine speed has a value that lies within fifth prohibited range 410 or sixth prohibited range 412, undesired noise may occur when the engine is operating in intermediate cylinder mode 204.

Preferably, cylinder deactivation system 100 includes provisions for prohibiting cylinder deactivation when the current engine speed lies within one of these prohibited ranges in order to reduce or eliminate unwanted levels of noise. In some embodiments, control unit 104 may prohibit or stop cylinder deactivation in response to information received by sensors. In a preferred embodiment, control unit 104 may prohibit or stop cylinder deactivation in response to information received by engine speed sensor 121.

Figure 5:
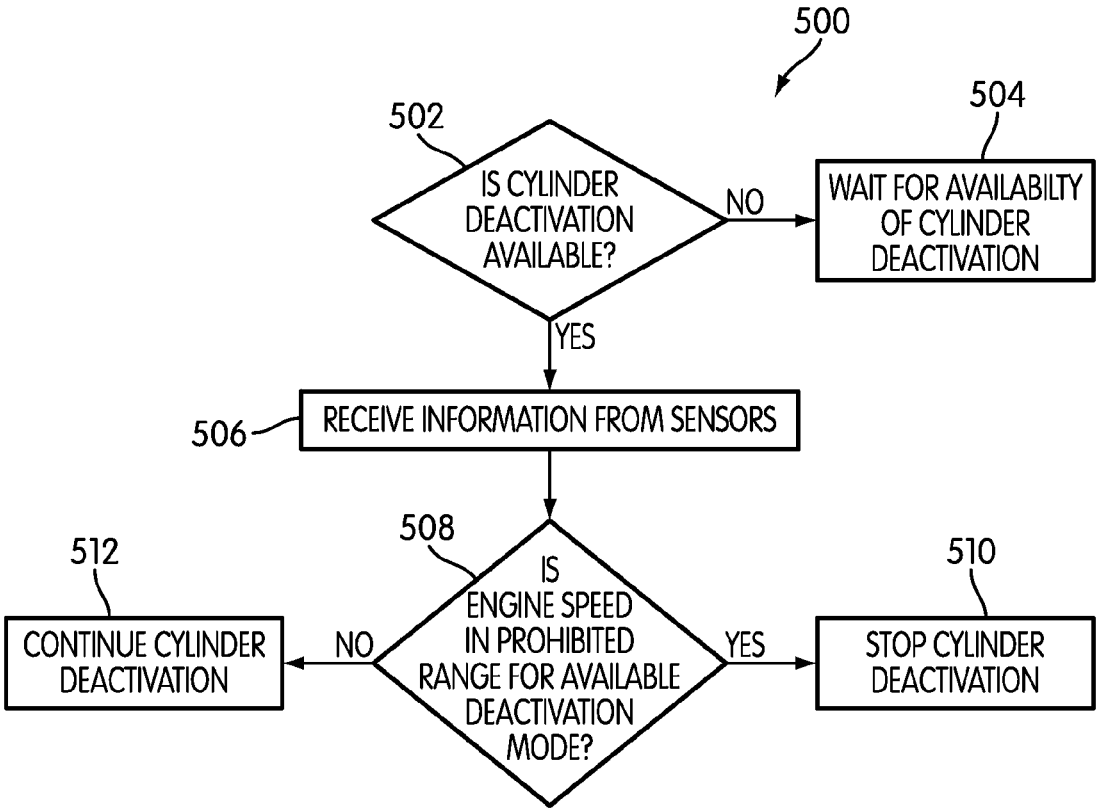
FIG. 5 is a preferred embodiment of a process for controlling cylinder deactivation.

FIG. 5 is a preferred embodiment of method 500 of a process for controlling cylinder deactivation between maximum cylinder mode 202 and minimum cylinder mode 206. For purposes of clarity, intermediate cylinder mode 204 is not available for engine 102 in the current embodiment. In other words, in the current embodiment, the only available deactivated cylinder mode is minimum cylinder mode 206. In other embodiments, a similar process could also be used to control cylinder deactivation between maximum cylinder mode 202 and intermediate cylinder mode 204.

The following steps are preferably performed by control unit 104. However, in some embodiments, some of the steps may be performed outside of control unit 104.

During a first step 502, control unit 104 preferably determines if cylinder deactivation is available. In other words, control unit 104 determines if engine 102 is currently in a deactivated mode or if engine 102 may switch to a cylinder deactivation mode soon. Preferably, the availability of cylinder deactivation is determined by current power demands on the engine, as previously discussed. In particular, the switching or continued running of engine 102 in minimum cylinder mode 206 is preferably determined according to current power demands.

If the engine is required to operate in maximum cylinder mode according to the current power demands, cylinder deactivation is not available, and control unit 104 may proceed to step 504. During step 504 control unit 104 waits for the availability of cylinder deactivation. If, during step 502, cylinder deactivation is available, in other words the engine may soon be or is operating in minimum cylinder mode 206, control unit 104 proceeds to step 506.

Once control unit 104 proceeds to step 506, control unit 104 preferably receives information from one or more sensors. In the current embodiment, control unit 104 preferably receives information from engine speed sensor 121. In other embodiments, control unit 104 could receive information from additional sensors as well.

Next, during step 508, control unit 104 determines if the current engine speed, as determined during the previous step 506, lies in a prohibited range associated with minimum cylinder mode 206. In the current embodiment, first prohibited range 320 (see FIG. 3) is the prohibited range associated with minimum cylinder mode 206. In other embodiments, however, any prohibited range could be used. If, during step 508, the current engine speed is determined to be within first prohibited range 320 associated with minimum cylinder mode 206, control unit 104 preferably proceeds to step 510. During step 510, control unit 104 stops or prohibits cylinder deactivation.

On the other hand, if, during step 508, the current engine speed is determined to be outside of first prohibited range 320 associated with minimum cylinder mode 206, control unit 104 preferably proceeds to step 512. In this embodiment, the current engine speed could lie outside first prohibited range 320 if it is either below first lower limit L1 or above first upper limit L2. During step 512, control unit 104 preferably continues, or permits, cylinder deactivation.

For the purposes of clarity, a single prohibited range was considered for each cylinder mode in the previous embodiment (see FIG. 3). However, in other embodiments, multiple prohibited regions could also be used. For example, returning to step 508 of the previous embodiment, control unit 104 may compare the current engine speed with the prohibited ranges 406 and 408 (see FIG. 4), associated with minimum cylinder mode 206. Whenever the current engine speed is below lower limit L5 of third prohibited range 406 or above upper limit L8 of fourth prohibited range 408, control unit 104 may proceed to step 512 to permit or continue cylinder deactivation. Likewise, whenever the current engine speed is between upper limit L6 and lower limit L7, control unit 104 may proceed to step 512 to permit or continue cylinder deactivation. Alternatively, whenever the current speed is between lower limit L5 and upper limit L6 of the third prohibited range 406 or between lower limit L7 and upper limit L8 of the fourth prohibited range 408, control unit 104 may proceed to step 510 to stop or prohibit cylinder deactivation. A similar process could also be applied to prohibit intermediate cylinder mode 204, using prohibited ranges 410 and 412.

By using this single or multiple prohibited range configuration, the range of engine speeds over which cylinder deactivation is prohibited can be confined to smaller discrete ranges, rather than a single large range that includes all of the speeds associated with unacceptable noise. In previous designs, a single threshold value for a parameter such as engine speed has been used to determine if cylinder deactivation should be prohibited or stopped. Such designs limit the use of cylinder deactivation with speeds above (for example) the threshold value, even though the prohibited region may only include a small range of engine speeds associated with unacceptable noise. By increasing the range of engine speeds where cylinder deactivation is allowed, greater fuel efficiency can be achieved over other systems that use a single threshold value.

In the previous embodiment, the cylinder mode of the engine was assumed to be predetermined by power demands. In particular, either one deactivation mode (minimum deactivation mode 206 or intermediate deactivation mode 204) was available to engine 102, according to power demands, or engine 102 was operated in maximum cylinder mode 202. In some cases, the available cylinder mode as determined by power demands may not be allowed due to prohibited values of engine speed, however another deactivated mode may be allowed for the same engine speed. For example, the current engine speed could lie within a prohibited range associated with minimum cylinder mode 206 and prevents engine 102 from switching to or continuing to operate in minimum cylinder mode 206. However, if the current engine speed does not lie in a prohibited region for operating engine 102 in intermediate cylinder mode 204, control unit 104 could switch engine 102 to intermediate cylinder mode 204, rather than completely stopping or prohibiting cylinder deactivation.

Figure 6:
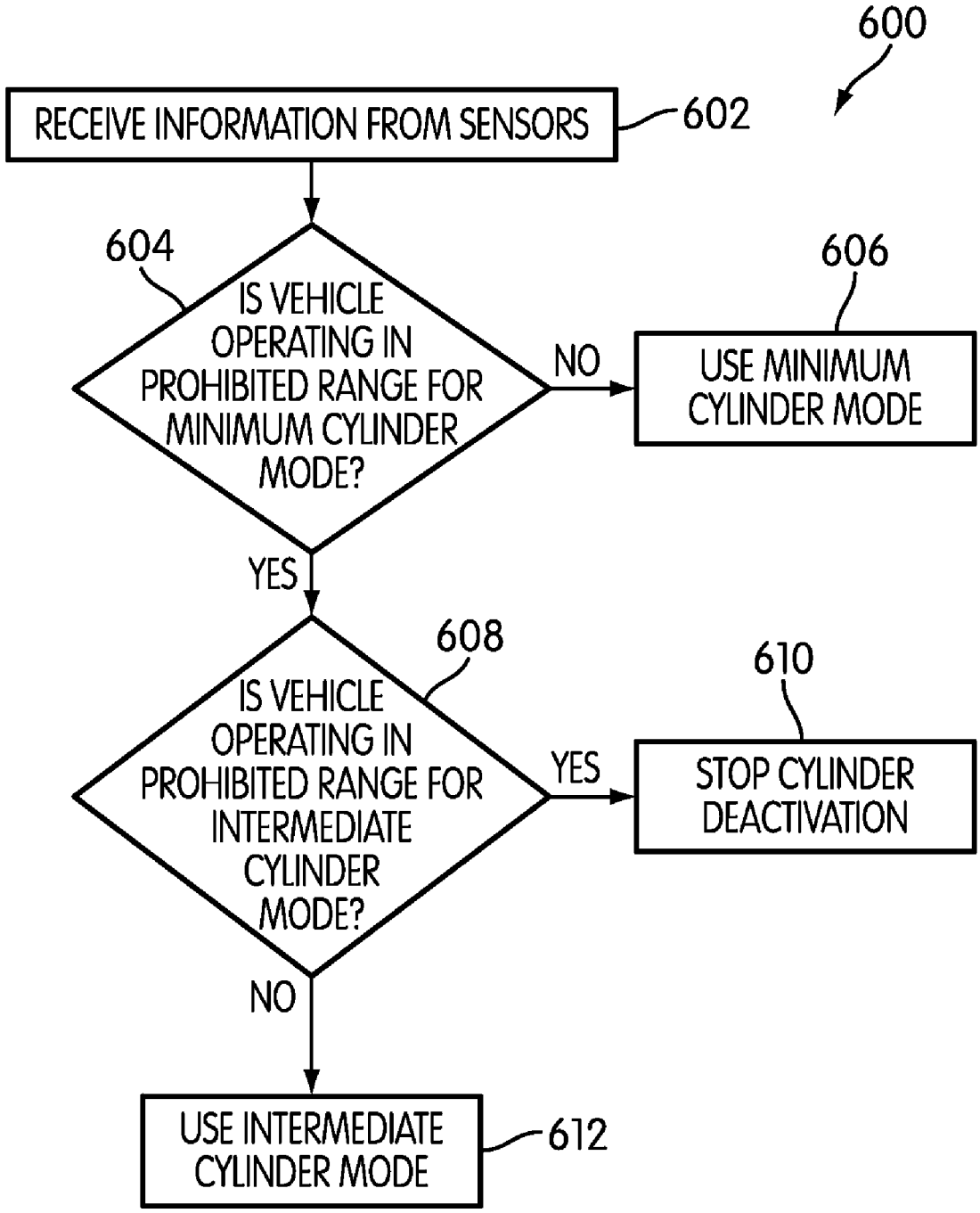
FIG. 6 is a preferred embodiment of a process for switching between deactivated cylinder modes.

FIG. 6 is a preferred embodiment of method 600 of a process for controlling cylinder deactivation system 100. In this embodiment, two cylinder deactivation modes are assumed to be available, including minimum cylinder mode 206 and intermediate cylinder mode 204, according to the current power demands. In other words, engine 102 is either currently operating in, or about to switch to, one of these two deactivated cylinder modes. In particular, the current power demands would allow for engine 102 to operate in either cylinder mode 204 or 206. Throughout the current embodiment, the prohibited ranges or unacceptable noise ranges associated with each of these cylinder modes 204 and 206 are the same as for the previous embodiment, which may be found in FIG. 3.

Starting at step 602, control unit 104 preferably receives information from at least one sensor. In a preferred embodiment, control unit 104 may receive information from vehicle speed sensor 121. In another embodiment, control unit 104 may receive information from additional sensors as well. Following this step 602, control unit 104 may proceed to step 604.

During step 604, control unit 104 may determine if engine 102 is operating in first prohibited range 320, associated with minimum cylinder mode 206. Because both minimum cylinder mode 206 and intermediate cylinder mode 204 are assumed to be available, control unit 104 is configured to start by checking to see if engine 102 could run in minimum cylinder mode 206, since typically the smallest engine displacement is preferred whenever more than one deactivated cylinder mode is available. If control unit 104 determines that the current engine speed does not lie within first prohibited range 320, control unit 104 preferably proceeds to step 606. During step 606, control unit 104 preferably switches engine 102 to, or allows engine 102 to continue in, minimum cylinder mode 206.

If, during step 604, control unit 104 determines that the current engine speed is within first prohibited range 320, control unit 104 preferably proceeds to step 608. During step 608, control unit 104 determines if the current engine speed is within second prohibited range 326 associated with intermediate cylinder mode 204. If the current engine speed is within second prohibited range 326, control unit 104 preferably proceeds to step 610. In the current embodiment, first prohibited region 320 and second prohibited region 326 do not overlap, and therefore the current engine speed could not be in both prohibited ranges. However, in embodiments where the prohibited regions do overlap, control unit 104 would proceed to step 610. During step 610, control unit 104 preferably stops or prohibits cylinder deactivation, since the current engine speed lies within both the first and second prohibited ranges. In this case, engine 102 is configured to operate in maximum cylinder mode 202.

If, during step 608, control unit 104 determines that the current engine speed is outside of second prohibited range 326, control unit 104 preferably proceeds to step 612. During step 612, engine 102 is preferably configured to operate in intermediate cylinder mode 204.

Using this method, engine 102 may be operated in any deactivated cylinder mode where the current engine speed is not within a prohibited range of speeds associated with the deactivated cylinder mode and the deactivated cylinder mode is available according to current power demands. This configuration allows increased fuel efficiency, since engine 102 may operate in a deactivated cylinder mode by switching between two or more deactivated cylinder modes when the current engine speed falls within the prohibited range of one deactivation mode, but not within a prohibited range of the other deactivated mode.

Although the current embodiment includes two deactivated cylinder modes, in other embodiments, additional deactivated cylinder modes could be used. Furthermore, throughout the remainder of this detailed description, wherever a method or process is given for controlling cylinder deactivation system 100, it should be understood that the method or process could be modified for switching between any available deactivated cylinder modes.

The current embodiment is only intended to illustrate a method for controlling cylinder deactivation according to engine speed. In other embodiments, other parameters may be associated with unacceptable levels of noise for certain values of those parameters. Using a process or method similar to the method used for controlling cylinder deactivation according to engine speed, control unit 104 could be configured to control cylinder deactivation according to these other parameters.

In another embodiment, vehicle speed could be used to control cylinder deactivation. Vehicle speed is important because it may be associated with various driveline vibrations that can lead to unacceptable noise whenever engine 102 is in a deactivated cylinder mode. As with the previous embodiment, one or more discrete ranges of vehicle speeds associated with unacceptable noise could be identified and control unit 104 could prohibit cylinder deactivation whenever the current vehicle speed is within one of these prohibited ranges.

Figure 7:
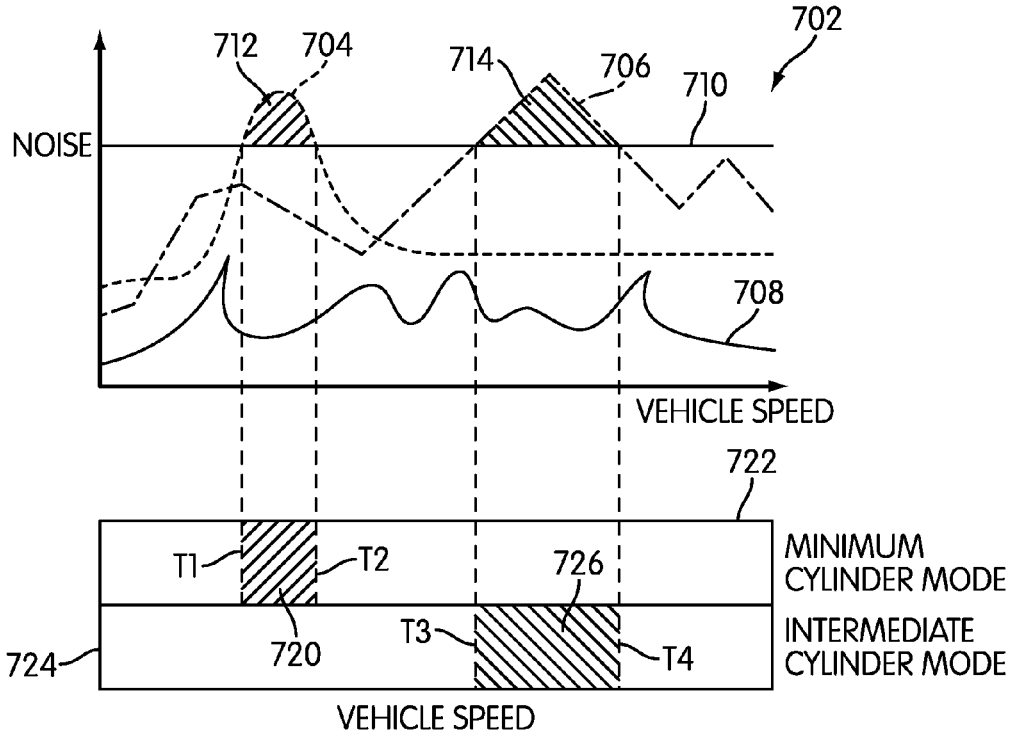
FIG. 7 is a preferred embodiment of a relationship showing prohibited noise regions.

Referring to FIG. 7, discrete ranges of vehicle speed could be associated with unacceptable levels of noise whenever engine 102 is in a deactivated cylinder mode. Relationship 702 is a preferred embodiment of noise vs. vehicle speed for various engine displacement modes. In particular, minimum cylinder line 704, intermediate cylinder line 706 and maximum cylinder line 708 are illustrated and represent the value of noise as a function of vehicle speed for minimum cylinder mode 206, intermediate cylinder mode 204 and maximum cylinder mode 202 (see FIG. 2), respectively. Noise limit 710 represents the upper limit on acceptable noise. As seen in FIG. 7, minimum cylinder line 704 includes third peak 712, disposed above noise limit 710. Also, intermediate cylinder line 706 includes fourth peak 714, disposed above noise limit 710. Finally, it is clear that maximum cylinder line 708 is disposed below noise limit 710 for all speeds. This is to be expected since, presumably, engine 102 (see FIG. 1) is tuned to limit noise for maximum cylinder mode 206 (see FIG. 2) at all vehicle speeds.

In this preferred embodiment, third peak 712 of minimum cylinder line 704 corresponds to a range of vehicle speeds within first vehicle speed range 722. First vehicle speed range 722 preferably includes the entire range of possible vehicle speeds for the motor vehicle associated with engine 102. In particular, third peak 712 of minimum cylinder line 704 corresponds to first prohibited range 720. First prohibited range 720 may be limited below by first lower limit T1 and bounded above by first upper limit T2. In this embodiment, if the vehicle speed has a value that lies within first prohibited range 720, undesired noise may occur when the engine is operating in minimum cylinder mode 206.

Fourth peak 714 of intermediate cylinder line 706 also preferably corresponds to a range of vehicle speeds within second vehicle speed range 724. Second vehicle speed range 724 is preferably identical to first vehicle speed range 722, including the entire range of possible vehicle speeds for the motor vehicle associated with engine 102. In particular, fourth peak 714 of intermediate cylinder line 706 corresponds to second prohibited range 726. Second prohibited range 726 may be limited below by second lower limit T3 and bounded above second upper limit T4. In this embodiment, if the vehicle speed has a value that lies within the second prohibited range 726, undesired noise may occur when the engine is operating in intermediate cylinder mode 204.

As with the previous embodiment, each deactivated cylinder mode 204 and 206, may include multiple prohibited ranges for vehicle speed. These multiple prohibited ranges of vehicle speed may vary for different embodiments.

Preferably, cylinder deactivation system 100 includes provisions for prohibiting cylinder deactivation when the vehicle speed lies within one of these prohibited ranges in order to reduce or eliminate unwanted levels of noise. In some embodiments, control unit 104 may prohibit or stop cylinder deactivation in response to information received by sensors. In a preferred embodiment, control unit 104 may prohibit or stop cylinder deactivation in response to information received by vehicle speed sensor 122.

Figure 8:
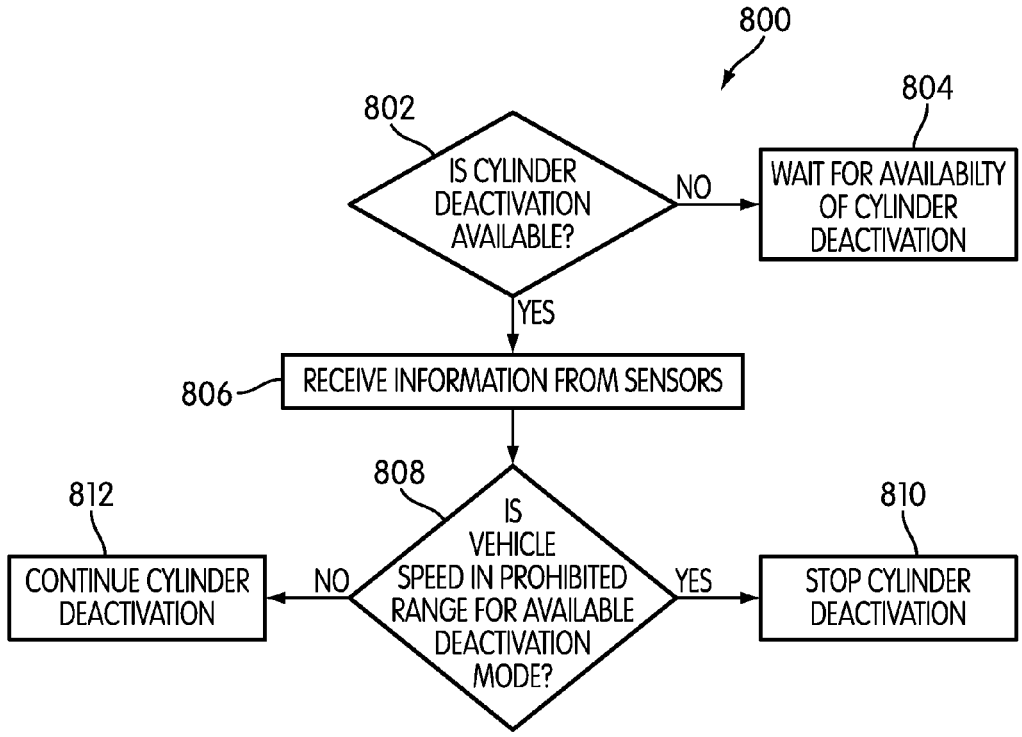
FIG. 8 is a preferred embodiment of a process for controlling cylinder deactivation.

FIG. 8 is a preferred embodiment of method 800 of a process for controlling cylinder deactivation between maximum cylinder mode 202 and minimum cylinder mode 206. For purposes of clarity, intermediate cylinder mode 204 is not available for engine 102 in the current embodiment. In other words, in the current embodiment, the only available deactivated cylinder mode is minimum cylinder mode 206. In other embodiments, a similar process could also be used to control cylinder deactivation between maximum cylinder mode 202 and intermediate cylinder mode 204. The following steps are preferably performed by control unit 104. However, in some embodiments, some of the steps may be performed outside of control unit 104.

During a first step 802, control unit 104 preferably determines if cylinder deactivation is available. In other words, control unit 104 determines if engine 102 is currently in a deactivated mode or if engine 102 may switch to a cylinder deactivation mode soon. Preferably, the availability of cylinder deactivation is determined by current power demands on the engine, as previously discussed. In particular, the switching or continued running of engine 102 in minimum cylinder mode 206 is preferably determined according to current power demands.

If the engine is required to operate in maximum cylinder mode according to the current power demands, cylinder deactivation is not available, and control unit 104 may proceed to step 804. During step 804 control unit 104 waits for the availability of cylinder deactivation. If, during step 802, cylinder deactivation is available, in other words the engine may soon be or is operating in minimum cylinder mode 206, control unit 104 proceeds to step 806.

Once control unit 104 proceeds to step 806, control unit 104 preferably receives information from one or more sensors. In the current embodiment, control unit 104 preferably receives information from vehicle speed sensor 122. In other embodiments, control unit 104 could receive information from additional sensors as well.

Next, during step 808, control unit 104 determines if the current vehicle speed, as determined during the previous step 806, lies in a prohibited range associated with minimum cylinder mode 206. In the current embodiment, first prohibited range 720 (see FIG. 7) is the prohibited range associated with minimum cylinder mode 206. In other embodiments, however, any prohibited range could be used. If, during step 808, the current vehicle speed is determined to be within first prohibited range 720 associated with minimum cylinder mode 206, control unit 104 preferably proceeds to step 810. During step 810, control unit 104 stops or prohibits cylinder deactivation.

On the other hand, if, during step 808, the current vehicle speed is determined to be outside of first prohibited range 720 associated with minimum cylinder mode 206, control unit 104 preferably proceeds to step 812. In this embodiment, the current vehicle speed could lie outside first prohibited range 720 if it is either below first lower limit T1 or above first upper limit LT. During step 812, control unit 104 preferably continues, or permits, cylinder deactivation.

As with the previous embodiment, multiple prohibited ranges could also be used during step 808. In this case, cylinder deactivation would be prohibited if the current vehicle speed was determined to be within any of the multiple prohibited ranges associated with minimum cylinder mode 206.

By using this single or multiple prohibited range configuration, the range of vehicle speeds over which cylinder deactivation is prohibited can be confined to smaller discrete ranges, rather than a single large range that includes all of the vehicle speeds associated with unacceptable noise. By increasing the range of vehicle speeds over which cylinder deactivation is allowed, greater fuel efficiency can be achieved over other systems that use a single threshold value.

Another cause of noise during deactivated cylinder modes is driveline vibrations that vary with different gears. In another embodiment, transmission conditions could be used to determine if cylinder deactivation should be prohibited due to undesired levels of noise associated with particular gears, or discrete ranges of gears.

Figure 9:
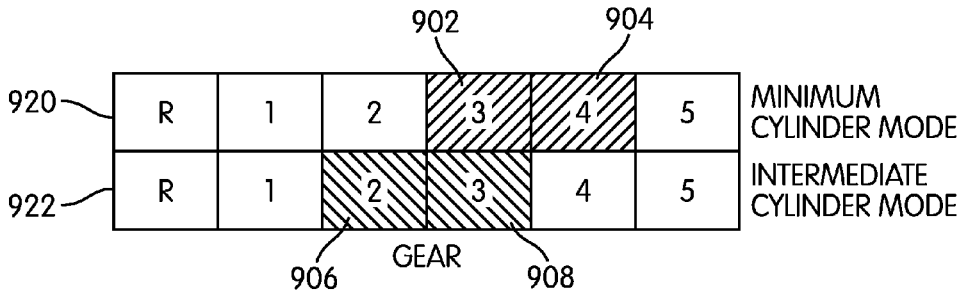
FIG. 9 is a preferred embodiment of a relationship showing prohibited noise regions.

Generally, prohibited regions could be defined by one or more gears that are associated with undesired noise during deactivated cylinder modes. FIG. 9 is a preferred embodiment of prohibited gears associated with minimum cylinder mode 206 and intermediate cylinder mode 204. In this embodiment, gear 902 and gear 904 are preferably associated with high levels of noise when engine 102 is in minimum cylinder mode 206 (associated with first gear range 920). Likewise, in this embodiment, gear 906 and gear 908 are associated with high levels of noise when engine 102 is in intermediate cylinder mode 204 (associated with second gear range 922).

In some cases, a motor vehicle may include a continuously variable transmission (CVT), rather than a standard transmission with fixed gear ratios. Under these circumstances, undesired NVH may occur within ranges of transmission conditions. The term 'transmission condition' refers to a particular state of the CVT system, corresponding to some value for the input/output ratio of the rotational shafts. As with previously discussed parameters such as vehicle speed and engine speed, the transmission condition of a CVT may take on any value within some predefined range.

Figure 10:
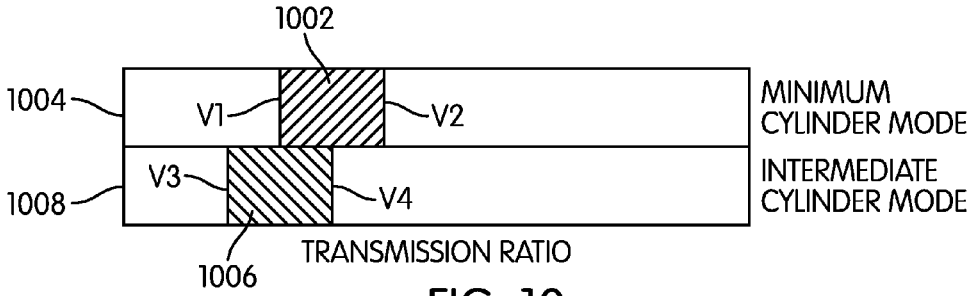
FIG. 10 is a preferred embodiment of a relationship showing prohibited noise regions.

FIG. 10 is a preferred embodiment of prohibited transmission conditions for an engine operating in minimum cylinder mode 206 and an engine operating in intermediate cylinder mode 204. In this embodiment, first prohibited region 1002 of first transmission condition range 1004 is bounded below by first lower value V1 and bounded above by first upper value V2. Second prohibited region 1006 of second transmission condition range 1008 in bounded below by second lower value V3 and bounded above by second upper value V4. As with the previous embodiment, each cylinder mode 204 and 206 may include multiple prohibited ranges for transmission conditions.

Preferably, cylinder deactivation system 100 includes provisions for prohibiting cylinder deactivation when the current transmission condition lies within one of these prohibited ranges in order to reduce or eliminate unwanted levels of noise. In some embodiments, control unit 104 may prohibit or stop cylinder deactivation in response to information received by sensors. In a preferred embodiment, control unit 104 may prohibit or stop cylinder deactivation in response to information received by transmission sensor 126.

Figure 11:
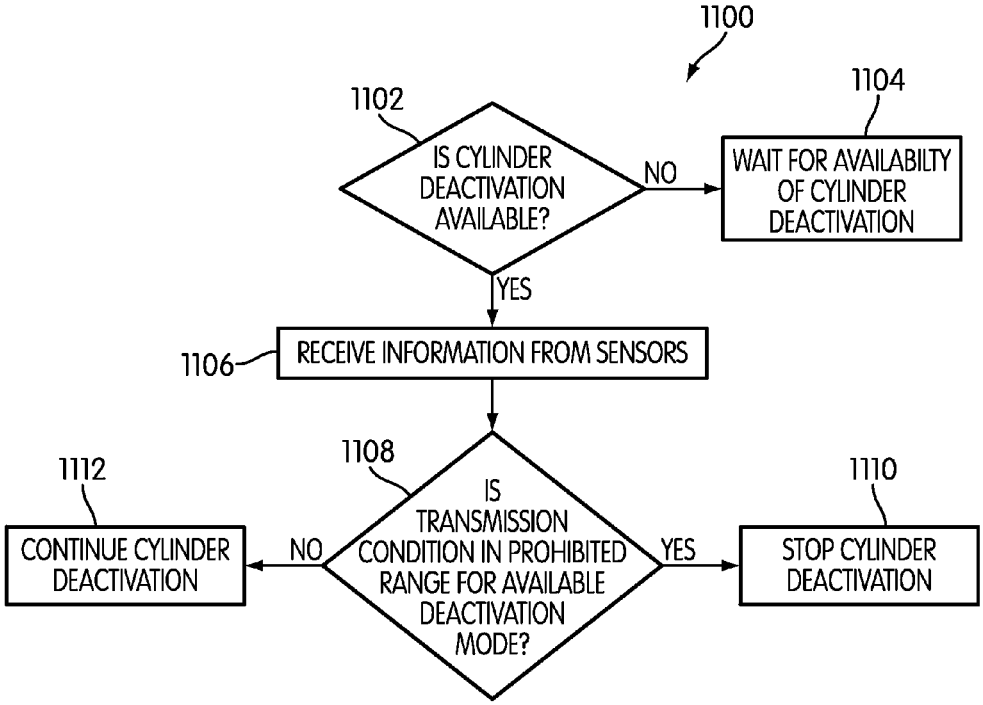
FIG. 11 is a preferred embodiment of a process for controlling cylinder deactivation

FIG. 11 is a preferred embodiment of method 1100 of a process for controlling cylinder deactivation between maximum cylinder mode 202 and minimum cylinder mode 206. For purposes of clarity, intermediate cylinder mode 204 is not available for engine 102 in the current embodiment. In other words, in the current embodiment, the only available deactivated cylinder mode is minimum cylinder mode 206. In other embodiments, a similar process could also be used to control cylinder deactivation between maximum cylinder mode 202 and intermediate cylinder mode 204. The following steps are preferably performed by control unit 104. However, in some embodiments, some of the steps may be performed outside of control unit 104.

During a first step 1102, control unit 104 preferably determines if cylinder deactivation is available. In other words, control unit 104 determines if engine 102 is currently in a deactivated mode or if engine 102 may switch to a cylinder deactivation mode soon. Preferably, the availability of cylinder deactivation is determined by current power demands on the engine, as previously discussed. In particular, the switching or continued running of engine 102 in minimum cylinder mode 206 is preferably determined according to current power demands.

If the engine is required to operate in maximum cylinder mode 202 according to the current power demands, cylinder deactivation is not available, and control unit 104 may proceed to step 1104. During step 1104 control unit 104 waits for the availability of cylinder deactivation. If, during step 502, cylinder deactivation is available, in other words the engine may soon be or is operating in minimum cylinder mode 206, control unit 104 proceeds to step 1106.

Once control unit 104 proceeds to step 1106, control unit 104 preferably receives information from one or more sensors. In the current embodiment, control unit 104 preferably receives information from transmission sensor 126. In other embodiments, control unit 104 could receive information from additional sensors as well.

Next, during step 1108, control unit 104 determines if the current transmission condition, as determined during the previous step 1106, lies in a prohibited range associated with minimum cylinder mode 206. In the current embodiment, first prohibited range 1002 (see FIG. 10) is the prohibited range associated with minimum cylinder mode 206. In other embodiments, however, any prohibited range could be used. If, during step 1108, the transmission condition is determined to be within first prohibited range 1002 associated with minimum cylinder mode 206, control unit 104 preferably proceeds to step 1110. During step 1110, control unit 104 stops or prohibits cylinder deactivation.

On the other hand, if, during step 1108, the current transmission condition is determined to be outside of first prohibited range 1002 associated with minimum cylinder mode 206, control unit 104 preferably proceeds to step 1112. In this embodiment, the current transmission ratio could lie outside first prohibited range 1002 if it is either below first lower limit V1 or above first upper limit V2. During step 1112, control unit 104 preferably continues, or permits, cylinder deactivation.

Alternatively, during step 1108, multiple prohibited ranges could be used.

By using this single or multiple prohibited range configuration, the range of transmission conditions over which cylinder deactivation is prohibited can be confined to smaller discrete ranges, rather than a single large range that includes all of the transmission conditions associated with unacceptable noise. By increasing the range of transmission conditions over which cylinder deactivation is allowed, greater fuel efficiency can be achieved over other systems that use a single threshold value.

In another embodiment, engine load conditions at a given engine speed could be used to determine if cylinder deactivation should be prohibited due to undesired levels of noise. In this embodiment, it may be important to know both the current engine speed and the current engine load in order to determine if the engine is operating within a prohibited region associated with unacceptable noise.

Figure 12:
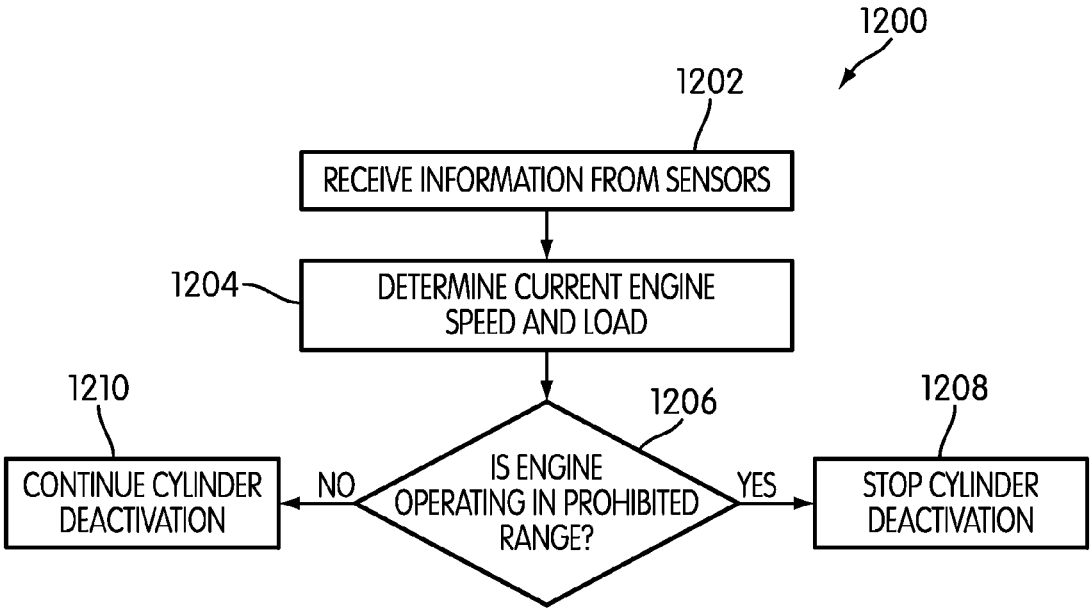
FIG. 12 is a preferred embodiment of a process for controlling cylinder deactivation.

FIG. 12 is a preferred embodiment of method 1200 of a process for controlling cylinder deactivation according to engine speed and engine load. In the current embodiment, it is assumed that control unit 104 has already determined that engine 102 is in a deactivated mode. During a first step 1202, control unit 104 preferably receives information from multiple sensors. Preferably, control unit 104 receives information from sensors associated with engine load conditions. In the current embodiment, control unit 104 may receive information from engine speed sensor 121, intake manifold sensor 123, throttle angle sensor 124 and/or airflow sensor 125. Next, during step 1204, control unit 104 may determine the current engine speed and engine load. In particular, using measurements made by one or more of sensors 123-125, control unit 104 could calculate or determine the current engine load and determine the current engine speed directly from engine speed sensor 121.

Figure 13:
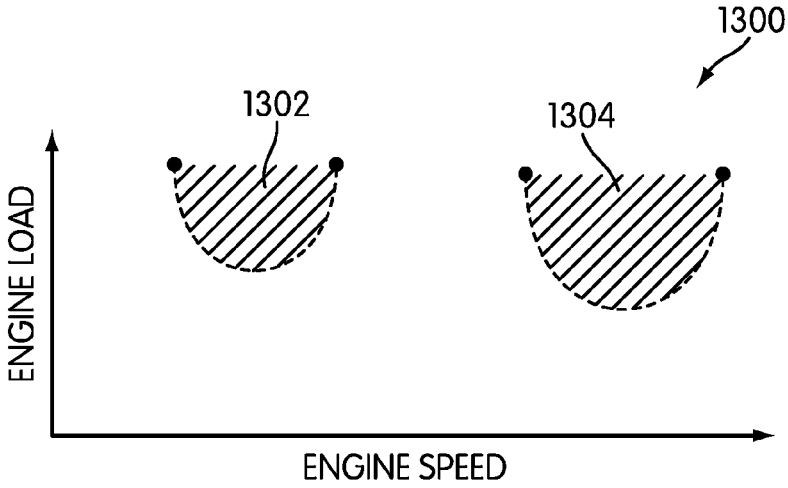
FIG. 13 is a preferred embodiment of a relationship showing prohibited noise regions.

Following step 1204, control unit 104 preferably proceeds to step 1206. During step 1206, control unit 104 may determine if the engine is operating in a prohibited region, according to a predetermined prohibited region. FIG. 13 is a preferred embodiment of relationship 1300 illustrating possible prohibited regions for minimum cylinder mode and intermediate cylinder mode. In particular, first prohibited region 1302 is preferably associated with minimum cylinder mode 206 and second prohibited mode 1304 is preferably associated with intermediate cylinder mode 204. Using relationship 1300, or a similar table, control unit 104 can determine if the current engine speed and engine load lie within the first prohibited region 1302 when the engine is operating in minimum cylinder mode 206 or within the second prohibited region when the engine is operating in intermediate cylinder mode 204. If the engine speed and engine load are associated with a point on relationship 1300 within the prohibited region associated with the available cylinder mode, control unit 104 may proceed to step 1208. During step 1208, control unit 104 preferably prohibits or stops cylinder deactivation. Otherwise control unit 104 may proceed to step 1210. During step 1210, control unit 104 preferably continues cylinder deactivation.

Figure 14:
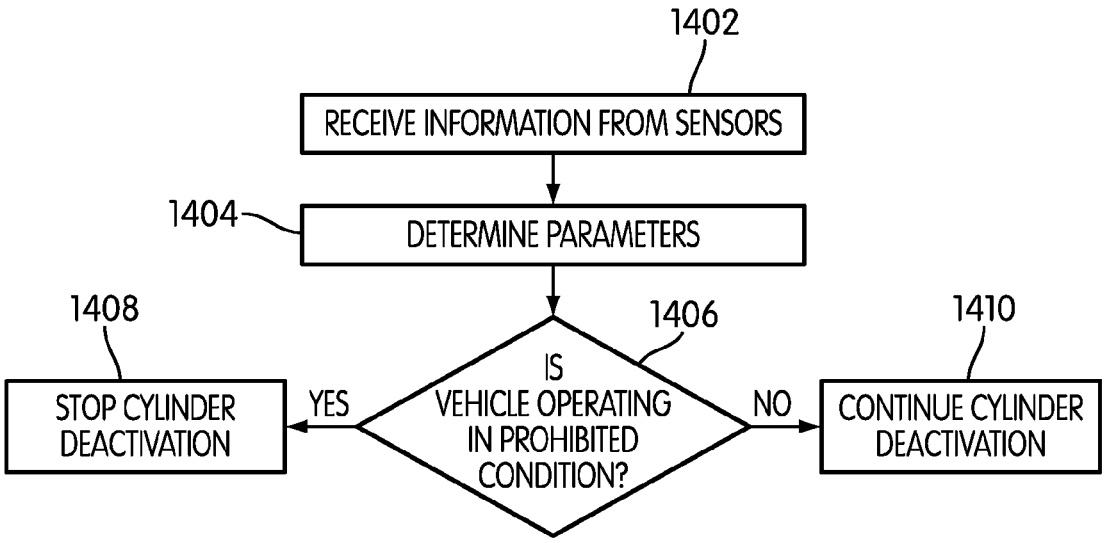
FIG. 14 is a preferred embodiment of a process for controlling cylinder deactivation.
Figure 15:
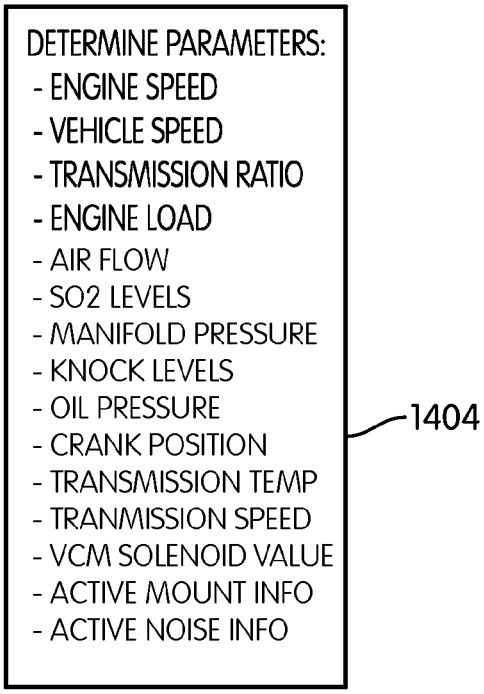
FIG. 15 is a preferred embodiment of a step of a process for controlling cylinder deactivation.

FIGS. 14 and 15 refer to a preferred embodiment of a general method for controlling cylinder deactivation using any parameters where predetermined prohibited ranges of the parameters (associated with undesired noise) are available. These parameters may be any of the parameters discussed previously, as well as other parameters for which discrete ranges of the parameters are associated with undesired noise.

During a first step 1402, control unit 104 may receive information from multiple sensors. In some embodiments, control unit 104 preferably receives information from engine speed sensor 121, vehicle speed sensor 122, intake manifold sensor 123, throttle angle sensor 124, airflow sensor 125 and transmission sensor 126. Additionally, in some embodiments, control unit 104 may receive information from a linear airflow sensor, an S02 sensor, a knock sensor, an oil pressure sensor, a crank position sensor, a transmission temperature sensor, a transmission speed sensor, a VCM solenoid sensor, an active mount sensor, as well as other types of sensors associated with a motor vehicle. Furthermore, in some embodiments, control unit 104 can receive information from one or more systems, including, but not limited to a drive-by-wire system and an active noise cancellation system, as well as other systems. It should be understood that in other embodiments, control unit 104 can receive information from any sensor or system associated with a motor vehicle.

Following step 1402, control unit 104 may proceed to step 1404. During step 1404, control unit 104 may determine the parameters relevant to controlling cylinder deactivation. FIG. 15 is a preferred embodiment of an exemplary list of the parameters referred to in step 1404. Generally, any sensed values or any values calculated by a control unit can be used to determine a region of limited cylinder deactivation activity. In some embodiments, these parameters may include, but are not limited to the engine speed, the vehicle speed, the transmission condition and the engine load. Additionally, these parameters can include airflow, SO2 levels, manifold pressure, knock levels, oil pressure, crank position, transmission temperature, transmission speed, VCM solenoid values, active mount information and active noise information. In still other embodiments, additional parameters can be used according to information received from any sensors as well as any calculated values determined by the control unit.

Next, control unit 104 preferably proceeds from step 1404 to step 1406, where control unit 104 may compare the parameters from the previous step 1404 with prohibited operating ranges for these parameters. Preferably, these prohibited operating ranges are predetermined operating ranges that are currently available to control unit 104. If the parameters are determined to be within the prohibited ranges associated with the operating parameters, control unit 104 preferably proceeds to step 1408, where control unit 104 prohibits or stops cylinder deactivation. Otherwise, control unit 104 may proceed to step 1410, where control unit 104 continues cylinder deactivation.

As previously discussed, the current embodiment could be modified to incorporate additional deactivated cylinder modes, as well as provisions for switching between various deactivated cylinder modes. Also, the prohibited ranges discussed here could be determined by any method, including empirical or theoretical considerations. In particular, there may be multiple prohibited ranges for any given parameter.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method for controlling cylinder deactivation in a motor vehicle having a first bank of cylinders and a second bank of cylinders, the first bank of cylinders including a first cylinder, a third cylinder, and a fifth cylinder, the second bank of cylinders including a second cylinder, a fourth cylinder, and a sixth cylinder, the method comprising the steps of:

determining availability of at least one cylinder deactivation mode, the at least one cylinder deactivation mode including a mode that deactivates at least one cylinder from the first bank and at least one cylinder from the second bank;

receiving information related to a parameter associated with an operating condition of the motor vehicle;

comparing the parameter with a predetermined prohibited range, the predetermined prohibited range having a lower limit and an upper limit; and prohibiting at least one cylinder deactivation mode when the parameter is within the predetermined prohibited range.

2. The method according to claim 1, wherein the parameter is engine speed.

3. The method according to claim 1, wherein the parameter is vehicle speed.

4. The method according to claim 1, wherein the parameter is transmission condition.

5. The method according to claim 1, wherein the parameter is engine load.

6. A method for controlling cylinder deactivation in a motor vehicle having a first bank of cylinders and a second bank of cylinders, the first bank of cylinders including a first cylinder, a third cylinder, and a fifth cylinder, the second bank of cylinders including a second cylinder, a fourth cylinder, and a sixth cylinder, the method comprising the steps of:

receiving information related to a parameter associated with an operating condition of the motor vehicle;

comparing the parameter with a predetermined prohibited range, the predetermined prohibited range having a lower limit and an upper limit;

permitting cylinder deactivation when a value of the parameter is below the lower limit of the predetermined prohibited range;

prohibiting cylinder deactivation when the parameter is within the predetermined prohibited range;

permitting cylinder deactivation when the value of the parameter is above the upper limit of the predetermined prohibited range; and wherein the lower limit has a value that is less than the upper limit, and wherein cylinder deactivation includes a deactivation of at least one cylinder from the first bank and at least one cylinder from the second bank.

7. The method according to claim 6, wherein the parameter is engine speed.

8. The method according to claim 6, wherein the parameter is vehicle speed.

9. The method according to claim 6, wherein the parameter is transmission condition.

10. The method according to claim 6, wherein the parameter is engine load.

11. The method according to claim 6, wherein there are multiple deactivated cylinder modes.

12. A method for controlling cylinder deactivation in a motor vehicle including an engine having a plurality of cylinders comprising the steps of:

establishing a maximum cylinder mode wherein all of the plurality of cylinders is operated;

establishing a minimum cylinder mode wherein a minimum number of cylinders is operated, wherein the minimum number is less than a maximum number;

establishing an intermediate cylinder mode wherein an intermediate number of cylinders is operated, wherein the intermediate number is less than the maximum number but greater than the minimum number;

receiving information related to a parameter associated with an operating condition of the motor vehicle;

comparing the parameter with a predetermined prohibited range;

prohibiting cylinder deactivation to the minimum number of cylinders when the parameter is within the predetermined prohibited range, but permitting cylinder deactivation to the intermediate number of cylinders.

13. The method according to claim 12, wherein the maximum number of cylinders is six.

14. The method according to claim 12, wherein the maximum number of cylinders is eight.

15. The method according to claim 12, wherein the maximum number of cylinders is ten.

16. The method according to claim 12, wherein the maximum number of cylinders is twelve.

17. The method according to claim 12, wherein the maximum number of cylinders is six, the minimum number is three and the intermediate number is four.

18. The method according to claim 12, wherein the maximum number of cylinders is eight, the minimum number is four and the intermediate number is six.

19. The method according to claim 12, wherein the maximum number of cylinders is ten, the minimum number is five and the intermediate number is six.

20. The method according to claim 12, wherein the maximum number of cylinders is twelve, the minimum number is six and the intermediate number is eight.

21. A method for controlling cylinder deactivation in a motor vehicle comprising the steps of:

determining the availability of a cylinder deactivation mode;

receiving information related to a parameter associated with an operating condition of the motor vehicle;

comparing the parameter with a first predetermined prohibited range and a second predetermined prohibited range, the first predetermined prohibited range having a first lower limit and a first upper limit and the second predetermined prohibited range having a second lower limit and a second upper limit;

the second lower limit being greater than the first upper limit; and prohibiting cylinder deactivation when the parameter is within either the first predetermined prohibited range or the second predetermined prohibited range, wherein cylinder deactivation is permitted when the parameter is above the second upper limit of the second predetermined prohibited range.

22. The method according to claim 21, wherein the parameter is engine speed.

23. The method according to claim 21, wherein the parameter is vehicle speed.

24. The method according to claim 21, wherein the parameter is engine load.

25. The method according to claim 21, wherein the parameter is transmission condition.

26. A method for controlling cylinder deactivation in a motor vehicle comprising the steps of:

receiving information related to a parameter associated with an operating condition of the motor vehicle;

comparing the parameter with a first predetermined prohibited range, the first predetermined prohibited range having a first lower limit and a first upper limit greater than the first lower limit;

comparing the parameter with a second predetermined prohibited range, the second predetermined prohibited range having a second lower limit and a second upper limit, the second lower limit being less than the second upper limit and greater than the first upper limit;

permitting cylinder deactivation when a value of the parameter is below the first lower limit of the first predetermined prohibited range;

prohibiting cylinder deactivation when the parameter is within the first predetermined prohibited range;

permitting cylinder deactivation when the value of the parameter is above the first upper limit of the first predetermined prohibited range and below the second lower limit of the second predetermined prohibited range;

prohibiting cylinder deactivation when the parameter is within the second predetermined prohibited range; and permitting cylinder deactivation when the value of the parameter is above the second upper limit of the second predetermined prohibited range.

27. The method according to claim 26, wherein the parameter is engine speed.

28. The method according to claim 26, wherein the parameter is vehicle speed.

29. The method according to claim 26, wherein the parameter is transmission condition.

30. The method according to claim 26, wherein the parameter is engine load.

* * * * *